US008565467B1

(12) United States Patent
Tseng

(10) Patent No.: US 8,565,467 B1
(45) Date of Patent: Oct. 22, 2013

(54) EARPHONE

(75) Inventor: Mu-Tsun Tseng, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 8 days.

(21) Appl. No.: 13/435,219

(22) Filed: Mar. 30, 2012

(51) Int. Cl.
*H04R 25/00* (2006.01)
*H04R 25/02* (2006.01)

(52) U.S. Cl.
USPC ..... 381/373; 381/374; 381/379; 381/380; 181/129; 181/130

(58) Field of Classification Search
USPC ..... 381/373–374, 379–380; 181/129–130
See application file for complete search history.

(56) References Cited

U.S. PATENT DOCUMENTS

| | | | | |
|---|---|---|---|---|
| 8,107,663 | B2 * | 1/2012 | Lin | 381/371 |
| 2007/0036385 | A1 * | 2/2007 | Harvey et al. | 381/388 |
| 2012/0114160 | A1 * | 5/2012 | Lin | 381/380 |

* cited by examiner

*Primary Examiner* — Duc Nguyen
*Assistant Examiner* — Matthew Eason

(57) ABSTRACT

An earphone includes a front housing, a tuning element, a rear housing and a loudspeaker. The front housing has a hollow sound tube, a sealed cover and a sealed barrel. The sealed cover defines a tuning hole. The sealed barrel defines a leaking hole connecting between the tuning hole and an external space of the earphone. The tuning element rotatably mounted to the front housing has a tuning pillar inserted in the tuning hole. The tuning pillar defines a tuning fillister. The rear housing is assembled forward to the front housing for locating the loudspeaker between the front housing and the rear housing. A sound cavity is formed among the front housing, the rear housing and the loudspeaker, and is communicated with the tuning fillister. A relative position of the tuning fillister and the leaking hole is capable of being modulated by means of rotating the tuning element.

5 Claims, 5 Drawing Sheets

EARPHONE

BACKGROUND OF THE INVENTION

1. Field of the Invention

The present invention generally relates to an earphone, and more particularly to an earphone capable of tuning a bass intensity of sounds.

2. The Related Art

Nowadays, earphones acted as peripheral devices of electronic products are very popular with people. The earphone generally includes a housing and a loudspeaker. The loudspeaker is assembled in the housing to define a sound cavity between the housing and the loudspeaker. The housing defines a plurality of through-holes in the proximity of the loudspeaker for allowing sounds generated by the loudspeaker to spread outward via the through-holes. However, the sound cavity has a predetermined and constant air capacity according to the above-mentioned description, so an air output and a flow velocity of air in the sound cavity of the earphone are regular to make a bass frequency response of the earphone invariable for getting a constant bass intensity, on the premise that the earphone keeps being used for the same electronic product and working in the same external environment. As a result, only one kind of bass feeling can be provided for listeners and fails to meet the entertainment needs of the listeners.

In consideration of defects of the earphone described above, an innovative earphone is developed for providing the diverse bass feelings for the listeners to satisfy the entertainment needs of the listeners.

SUMMARY OF THE INVENTION

An object of the present invention is to provide an earphone includes a front housing, a tuning element, a rear housing, and a loudspeaker for generating sounds. The front housing has a hollow sound tube. A rear periphery of the sound tube spreads outward to form a sealed cover. An outer periphery of the sealed cover extends rearward to form a sealed barrel. The sealed cover defines a locating groove and a tuning hole arranged tandem to respectively penetrate through a front side and a rear side of the sealed cover. The tuning hole communicates with a rear end of the locating groove. The sealed barrel defines a leaking hole connecting between the tuning hole and an external space of the earphone. The tuning element is rotatably mounted to the front housing. The tuning element has a base block located in the locating groove. A rear of the base block extends rearward to form a tuning pillar inserted in the tuning hole. One side of the tuning pillar is concaved inward to form a tuning fillister penetrating rearward through the tuning pillar. The rear housing is assembled forward to the front housing for locating the loudspeaker between the front housing and the rear housing. A sound cavity is formed among the front housing, the rear housing and the loudspeaker. The tuning fillister is further communicated with the sound cavity. A relative position of the tuning fillister and the leaking hole is capable of being modulated by means of rotating the tuning element to control an air output and a flow velocity of air in the sound cavity so as to tune a bass intensity of the sounds.

As described above, the tuning element is rotatably mounted to the front housing of the earphone to control the air output and the flow velocity of the air in the earphone so as to tune the bass intensity of the sounds under bass frequencies between 20 Hz and 20 KHz to provide different bass feelings for listeners by means of modulating the relative position of the tuning fillister and the leaking hole through rotating the tuning element.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
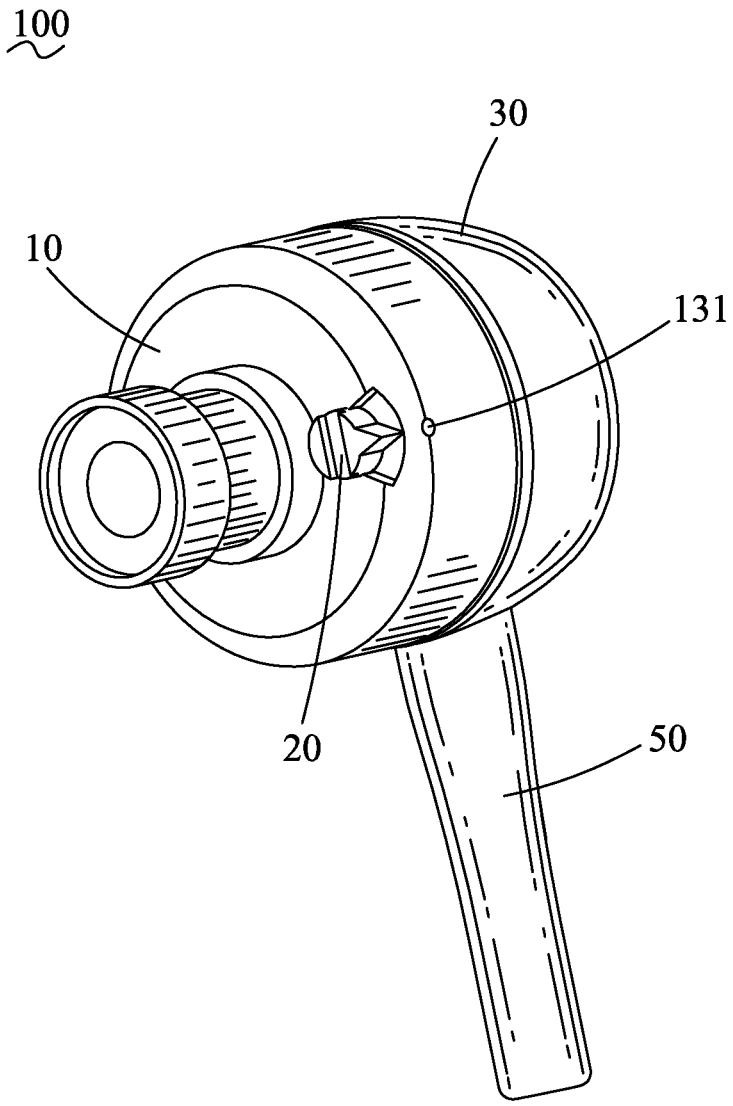
FIG. 1 is a perspective view of an earphone in accordance with the present invention.
Figure 2:
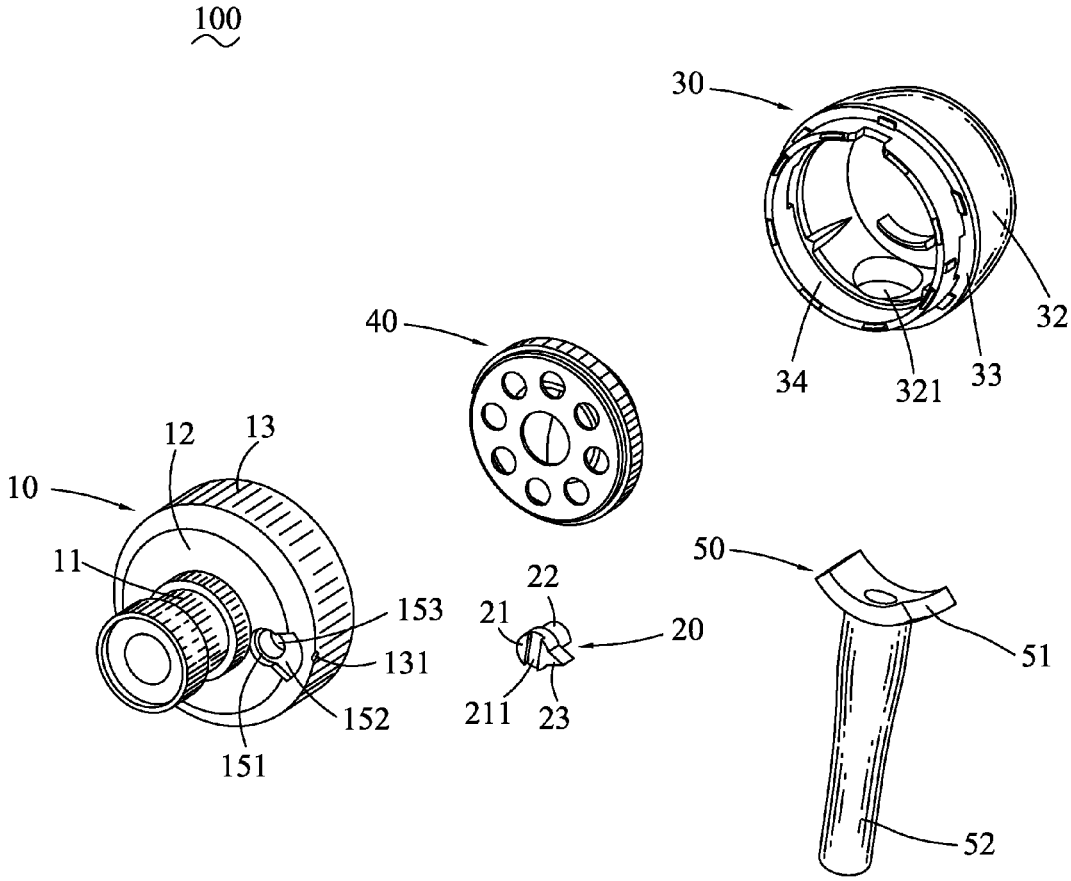
FIG. 2 is an exploded view of the earphone of FIG. 1.

With reference to FIG. 1 and FIG. 2, an earphone 100 in accordance with the present invention is shown. The earphone 100 includes a front housing 10, a tuning element 20, a rear housing 30, a loudspeaker 40 and a hand shank 50.

Figure 3:
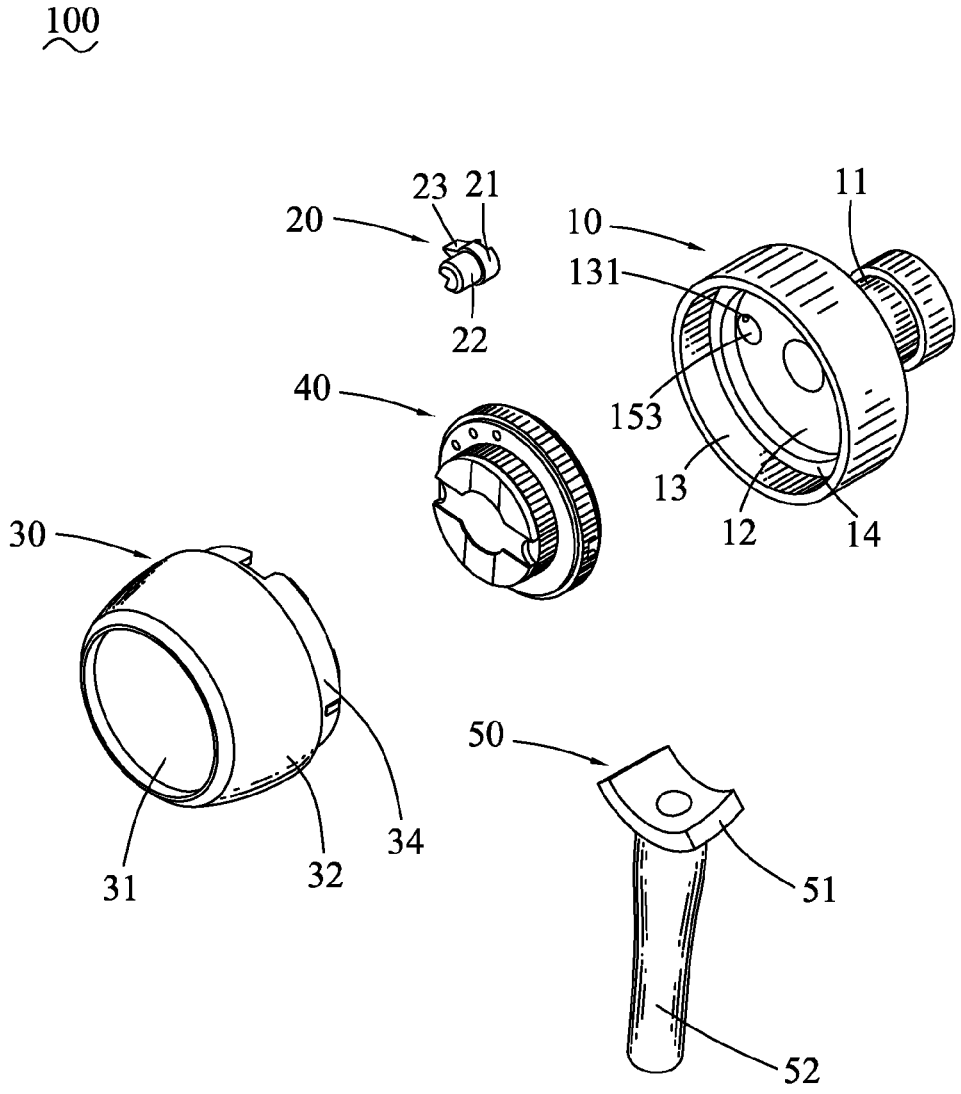
FIG. 3 is another exploded view of the earphone of FIG. 1.
Figure 4:
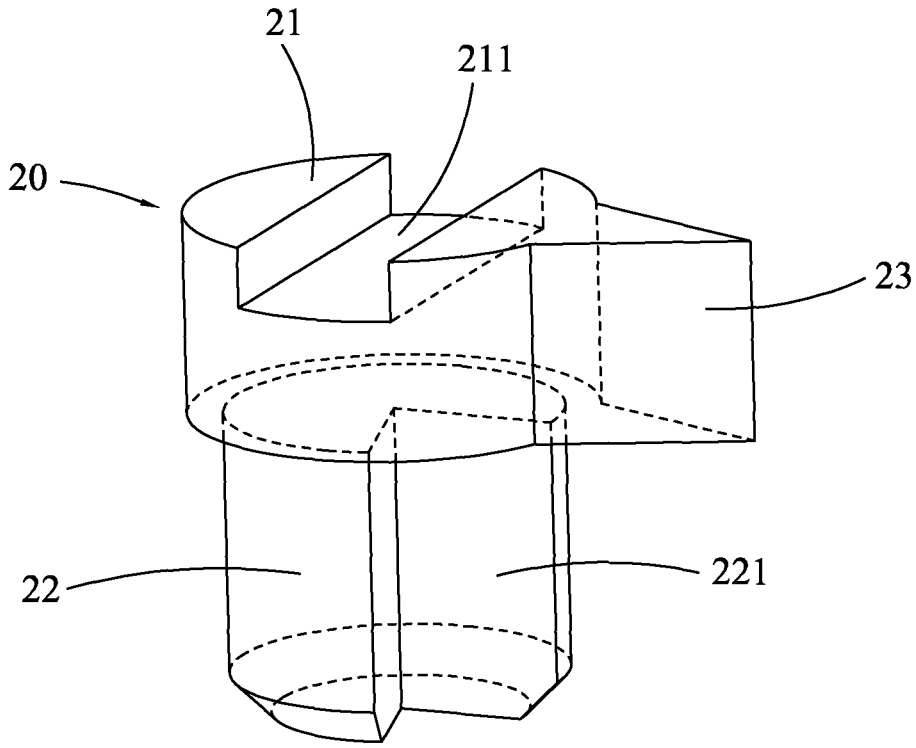
FIG. 4 is a perspective view of a tuning element of the earphone of FIG. 2.
Figure 5:
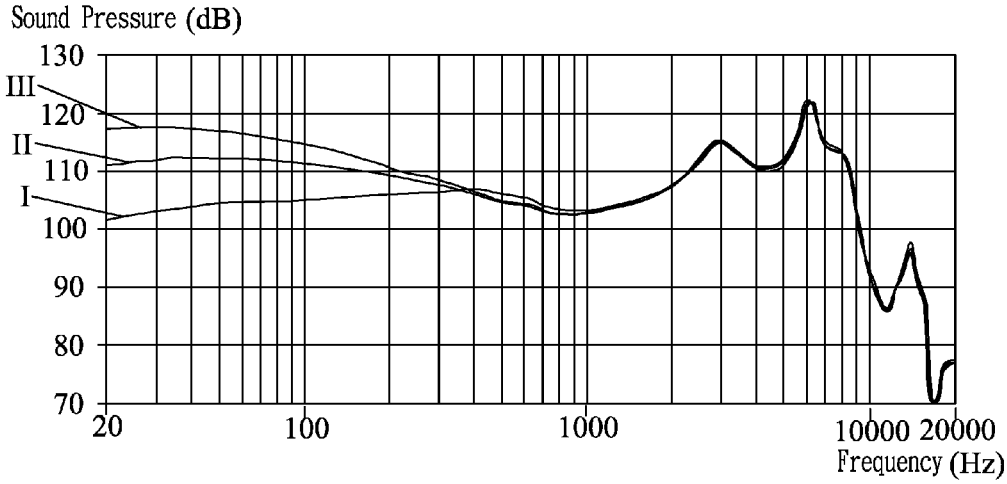
FIG. 5 is a frequency response chart showing different statuses of the earphone of FIG. 1.

Referring to FIGS. 1-3, the front housing 10 has a hollow sound tube 11 disposed horizontally. A rear periphery of the sound tube 11 spreads outward to form a sealed cover 12. An outer periphery of the sealed cover 12 extends rearward to form a ring-shaped sealed barrel 13. A ring-shaped supporting wall 14 connects with a front inner periphery of the sealed barrel 13 and a rear surface of the sealed cover 12. The sealed cover 12 defines a circular locating groove 151 and a tuning hole 153 arranged tandem to respectively penetrate through a front side and a rear side of the sealed cover 12. The tuning hole 153 communicates with a rear end of the locating groove 151 and is narrower than the locating groove 151 in diameter. The front side of the sealed cover 12 further defines a fan-shaped sliding groove 152 connecting with one side of the locating groove 151. The sealed barrel 13 defines a leaking hole 131 connecting between the tuning hole 153 and an external space of the earphone 100.

Referring to FIGS. 1-4, the tuning element 20 has a cylindrical base block 21. A side of the base block 21 protrudes sideward to form a triangle-shaped limiting block 23. A middle of a rear of the base block 21 extends rearward to form a tuning pillar 22. A middle of a front of the base block 21 defines a rotating slot 211 vertically penetrating therethrough. One side of the tuning pillar 22 is concaved inward to form a tuning fillister 221 penetrating rearward through the tuning pillar 22 and adjacent to the limiting block 23.

Referring to FIG. 2 and FIG. 3, the rear housing 30 has a rear wall 31 and a blocking wall 32 surrounding a periphery of the rear wall 31. A bottom of the blocking wall 32 defines an assembling hole 321. A front periphery of the blocking wall 32 is connected with a ring-shaped connecting wall 33. An inner periphery of the connecting wall 33 protrudes forward to form an inserting wall 34. The hand shank 50 has an arc-shaped blocking portion 51 and an inserting portion 52 extending downward from a bottom of the blocking portion 51.

Referring to FIGS. 1-4, when the earphone 100 is assembled, the loudspeaker 40 for generating sounds is assembled forward to the front housing 10 with a front periphery of the loudspeaker 40 resisting against an inner periphery of a rear of the supporting wall 14. Then the rear housing 30 is assembled forward to the front housing 10 with the inserting wall 34 being attached to a rear inner periphery of the sealed barrel 13 and resisting against an outer periphery of the rear of the supporting wall 14 for locating the loudspeaker 40 between the front housing 10 and the rear housing 30. Accordingly, a sound cavity (not shown) is formed among the front housing 10, the rear housing 30 and the loudspeaker 40. The tuning fillister 221 is further communicated with the sound cavity. The sound cavity is communicated with the sound tube 11 for allowing the sounds generated by the loudspeaker 40 to spread outward via the sound tube 11. The tuning element 20 is rotatably mounted to the front housing 10. The tuning pillar 22 of the tuning element 20 is inserted in the tuning hole 153 of the front housing 10. The rear of the base block 21 is held in the locating groove 151 and is against the fault junction of the tuning hole 153 the locating groove 151. The limiting block 23 is located in the sliding groove 152 and is restrainedly rotatable between two radial groove walls of the fan-shaped sliding groove 152 for limiting a rotating angle of the tuning element 20 so as to decide a relative position of the tuning fillister 221 and the leaking hole 131. The inserting portion 52 of the hand shank 50 is inserted into the assembling hole 321 and is blocked by the blocking portion 51.

Referring to FIGS. 1-5, in use, a rotating element (not shown) is restricted in the rotating slot 211 of the tuning element 20 to drive the tuning element 20 to rotate. The relative position of the tuning fillister 221 and the leaking hole 131 is capable of being modulated by means of rotating the tuning element 20 to control an air output and a flow velocity of air in the sound cavity of the earphone 100 so as to tune a bass intensity of the sounds which is under bass frequencies between 20 Hz and 20 KHz to provide different bass feelings for listeners through the sound tube 11. Specifically, when the tuning element 20 is driven to rotate until the limiting block 23 resisting against one inner sidewall of the sliding groove 152 to close the tuning fillister 221 and the leaking hole 131 as well, in other word, the leaking hole 131 is completely sealed by the tuning pillar 22 of the tuning element 20, the earphone 100 shows a first status of a sound pressure in the sound cavity being maximum and the earphone 100 having the strongest bass intensity. A frequency response of the first status is shown in chart III. When the tuning element 20 is driven to rotate until the limiting block 23 resisting against the other inner sidewall of the sliding groove 152 to communicate the tuning fillister 221 with leaking hole 131, the earphone 100 shows a second status of the sound pressure in the sound cavity being minimum and the earphone 100 having the weakest bass intensity. A frequency response of the second status is shown in chart I. When the tuning element 20 is driven to rotate until the limiting block 23 being in a middle of the sliding groove 152 to partially communicate the tuning fillister 221 with the leaking hole 131, the earphone 100 shows a third status of the sound pressure in the sound cavity being in a middle value and the earphone 100 having a middle bass intensity. A frequency response of the third status is shown in chart II.

As described above, the tuning element 20 is rotatably mounted to the front housing 10 of the earphone 100 to control the air output and the flow velocity of the air in the sound cavity of the earphone 100 so as to tune the bass intensity of the sounds under the bass frequencies between 20 Hz and 20 KHz to provide the different bass feelings for the listeners by means of modulating the relative position of the tuning fillister 221 and the leaking hole 131 through rotating the tuning element 20.

What is claimed is:

1. An earphone, comprising:

a front housing having a hollow sound tube, a rear periphery of the sound tube spreading outward to form a sealed cover, an outer periphery of the sealed cover extending rearward to form a sealed barrel, the sealed cover defining a locating groove and a tuning hole arranged tandem to respectively penetrate through a front side and a rear side of the sealed cover, the tuning hole communicating with a rear end of the locating groove, the sealed barrel defining a leaking hole connecting between the tuning hole and an external space of the earphone;

a tuning element rotatably mounted to the front housing, the tuning element having a base block located in the locating groove, a rear of the base block extending rearward to form a tuning pillar inserted in the tuning hole, one side of the tuning pillar being concaved inward to form a tuning fillister penetrating rearward through the tuning pillar;

a loudspeaker for generating sounds; and a rear housing assembled forward to the front housing for locating the loudspeaker between the front housing and the rear housing, wherein a sound cavity is formed among the front housing, the rear housing and the loudspeaker, the tuning fillister is further communicated with the sound cavity, a relative position of the tuning fillister and the leaking hole is capable of being modulated by means of rotating the tuning element to control an air output and a flow velocity of air in the sound cavity so as to tune a bass intensity of the sounds.

2. The earphone as claimed in claim 1, wherein the tuning hole is narrower than the locating groove in diameter for holding the rear of the base block against a fault junction of the tuning hole and the locating groove.

3. The earphone as claimed in claim 1, wherein the front side of the sealed cover further defines a fan-shaped sliding groove connecting with one side of the locating groove, a side of the base block protrudes sideward to form a limiting block located in the sliding groove and being restrainedly rotatable between two radial groove walls of the sliding groove to decide the relative position of the tuning fillister and the leaking hole.

4. The earphone as claimed in claim 3, wherein a front of the base block defines a rotating slot, the tuning element is driven to rotate through the rotating slot.

5. The earphone as claimed in claim 1, wherein a bottom of the rear housing defines an assembling hole, the earphone further includes a hand shank assembled to the assembling hole.

* * * * *